US007320186B2

(12) United States Patent
Schöne

(10) Patent No.: US 7,320,186 B2
(45) Date of Patent: Jan. 22, 2008

(54) APPLIANCE DOOR HAVING SEE-THROUGH PORTION

(75) Inventor: Oliver Schöne, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 152 days.

(21) Appl. No.: 11/218,746

(22) Filed: Sep. 2, 2005

(65) Prior Publication Data

US 2007/0051012 A1 Mar. 8, 2007

(51) Int. Cl.
*F26B 11/02* (2006.01)
*D06F 17/00* (2006.01)

(52) U.S. Cl. ..... 34/603; 34/139; 68/196

(58) Field of Classification Search ..... 34/603, 34/139, 201; 68/196; 134/200
See application file for complete search history.

(56) References Cited

U.S. PATENT DOCUMENTS 4,053,992 A 10/1977 Furgal
5,190,807 A 3/1993 Kimock et al.
5,570,597 A 11/1996 Bongini et al.
5,664,340 A 9/1997 Brown
5,701,684 A 12/1997 Johnson
6,294,258 B1 9/2001 Gentile
6,381,874 B1 5/2002 Floyd
6,405,453 B1 6/2002 Salameh et al.
6,431,735 B2 8/2002 Fraizer
6,665,984 B2 12/2003 Bienick et al.
6,732,553 B2 5/2004 Rhode et al.

*Primary Examiner*—Jiping Lu
(74) *Attorney, Agent, or Firm*—Russell W. Warnock; James E. Howard

(57) ABSTRACT

A door for a household appliance comprising a door body having a cylindrical portal with a ridge extending radially inwardly from an end of the portal. The door body includes multiple receptacles disposed adjacent the portal and spaced around the portal. A rear glass piece is at least partially disposed within the portal and includes a flange extending around an outer edge of the rear glass. A view guide is at least partially disposed within the portal and includes a cylindrical portion having a lead edge and multiple hooks extending back from the lead edge with a barb disposed near an end of each hook. The hooks engage corresponding receptacles to connect the view guide to the door body and retain the rear glass within the door body. The flange of the rear glass is disposed between the ridge and the lead edge.

20 Claims, 10 Drawing Sheets

APPLIANCE DOOR HAVING SEE-THROUGH PORTION

FIELD OF THE INVENTION

The invention relates to a door for a household appliance having a see through portion, and more particularly to a dryer door having a see through portion.

BACKGROUND OF THE INVENTION

Household appliances, such as clothes dryers, generally include a door to provide access to the interior of the appliance. A clothes dryer commonly includes a housing, a rotating drum disposed within the housing, and a driver device for driving the rotating drum. Clothes or laundry are inserted into the dryer through the door and placed in the rotating drum and the door is then closed. Some existing clothes dryers include glass or see-through portions in the door to allow an operator to monitor the laundry while it is in the rotating drum. In these existing clothes dryers, the glass portion is usually mounted with screws, rivets, or other similar fastening devices.

BRIEF SUMMARY OF THE INVENTION

The present invention provides a door for a household appliance, such as a dryer, having a see-through portion permitting an operator to view laundry within the rotating drum while the dryer is in operation. The door utilizes a quick snap-fit connection to retain a glass piece within the door substantially free of additional fasteners. The door provides a smooth inner surface exposed to the interior of the dryer to minimize exposed edges that can catch laundry within the dryer.

The door includes a door body having a cylindrical portal with a ridge extending radially inwardly from an end of the portal. The ridge defines a rear aperture near an end of the portal. The door body includes multiple receptacles disposed adjacent the portal and spaced around the portal. A rear glass piece is at least partially disposed within the portal and includes a flange extending around an outer edge of the rear glass. The flange forms a stepped shoulder along the outer edge of the rear glass and the rear glass includes a raised central portion bulging outwardly from the flange. The central portion extends beyond the ridge and through the rear aperture.

A view guide is at least partially disposed within the portal and includes a cylindrical portion having a lead edge and multiple hooks extending back from the lead edge. The hooks are positioned radially outwardly from the cylindrical portion and are spaced along the perimeter of the view guide. Each hook includes a barb near an end of the hook opposite the lead edge facing radially outwardly from the cylindrical portion. The hooks engage corresponding receptacles to connect the view guide to the door body and retain the rear glass within the door body. The flange of the rear glass is disposed between the ridge of the portal and the lead edge of the view guide.

The barbs can include a slanted cam surface deflecting the hook when the view guide is being inserted into the door body, and the barbs can also include a straight catch surface that engages one of the receptacles when the view guide is fully inserted into the door body to retain the view guide within the door body.

In some aspects and in some constructions, the receptacles can include an aperture defined by the door body near the portal. The receptacles can also include a boss projecting radially inwardly from the door body near the portal.

In some aspects and in some constructions, a seal can be disposed adjacent the flange and being disposed between the flange and the ridge. The seal can have a U-shaped cross-section extending around an outer edge of the flange and contacting the ridge of the portal and the lead edge of the view guide.

In some aspects and in some constructions, the door can include a door front defining a front aperture and having a front glass covering the front aperture, the door front connected to the door body with the front glass and rear glass disposed at opposite ends of the view guide. The door front can be connected to the door body with a snap-fit connection, screws, or with other similar fastening means.

In some aspects and in some constructions, the household appliance includes a clothes dryer having a housing and the rotating drum and a drive device selectively driving the rotating drum disposed within the housing. The door is connected to the housing with a pivotal hinge and is movable between an open condition, in which the rotating drum is accessible, and a closed condition, in which the rotating drum is not accessible.

Other features and advantages of the present invention will become apparent to those skilled in the art upon review of the following detailed description and drawings.

BRIEF DESCRIPTION OF THE DRAWINGS

Particular details and further advantages are explained in more detail by reference to the following drawings, which are to illustrate the invention not restrictively, but merely by way of example, wherein there is shown schematically in.

Figure 1:
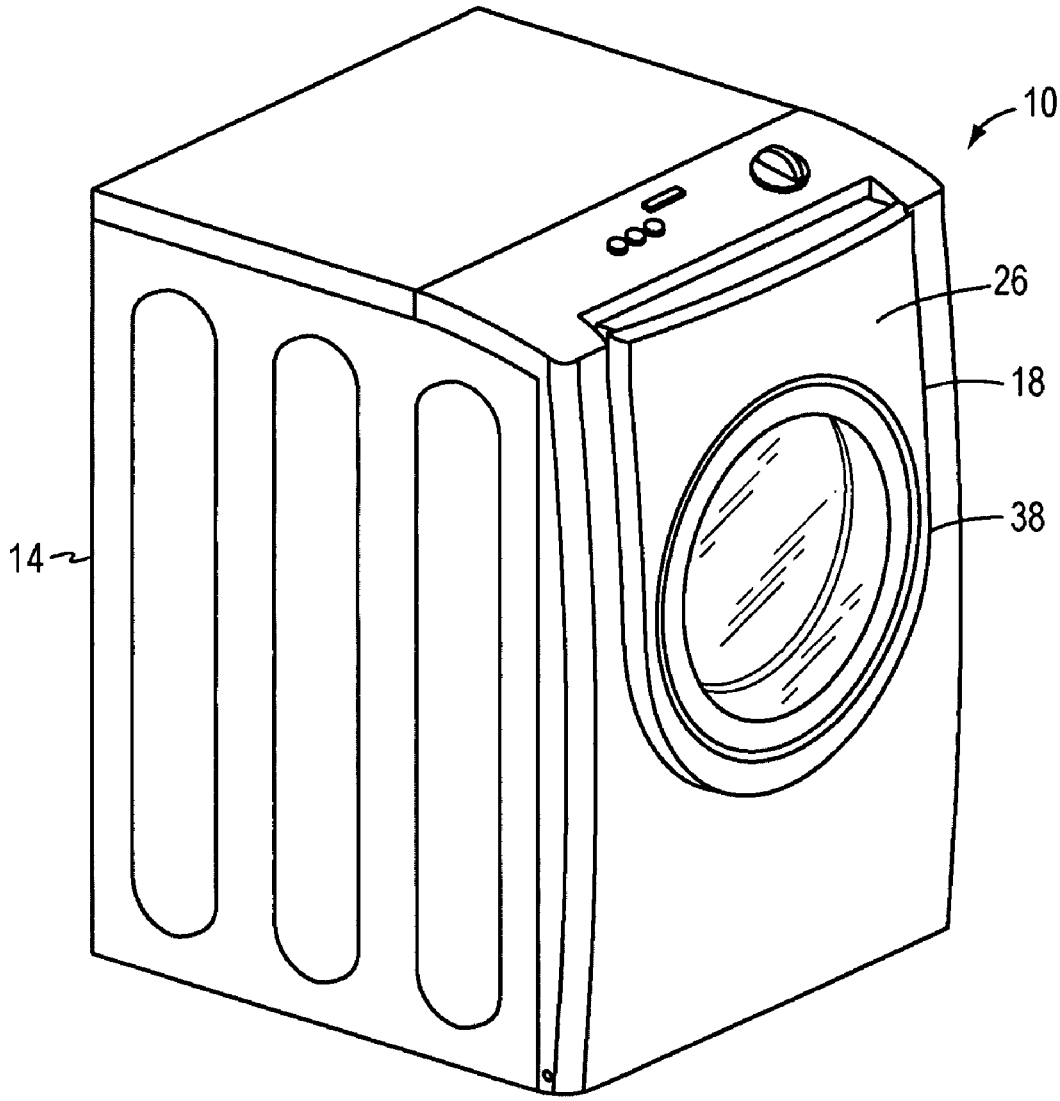
FIG. 1 illustrates a perspective view of a household appliance including a door embodying the present invention.

Before the embodiments of the invention are explained in detail, it is to be understood that the invention is not limited in its application to the details of construction and the arrangements of components set forth in the following description of illustrated in the drawings. The invention is capable of other embodiments and of being practiced or of being carried out in various ways. Also, it is to be understood that the phraseology and terminology used herein is for the purpose of description and should not be regarded as limiting. In addition, the drawings may not be drawn to scale.

DETAILED DESCRIPTION OF THE INVENTION

Figure 13:
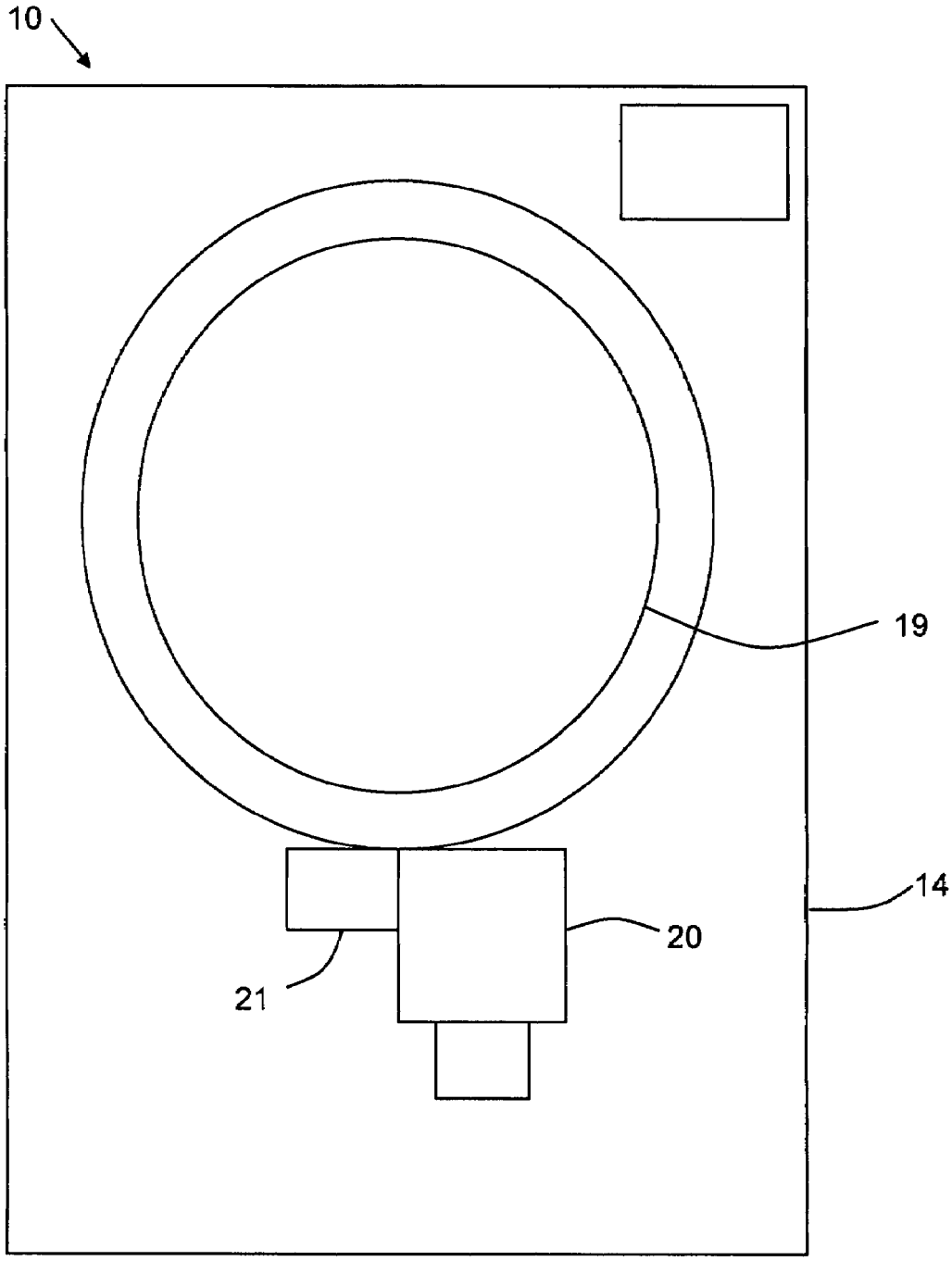
FIG. 13 illustrates a dryer embodying aspects of the invention.

FIG. 1 illustrates a clothes dryer 10 having a housing 14 and a door 18 connected to the housing 14. The door 18 is mounted with a hinge to pivot with respect to the housing 14 between an open condition and a closed condition. FIG. 1 shows the door 18 in the closed condition. A rotating drum 19 (see FIG. 13) and a drive device 20 (see FIG. 13) for driving the rotating drum are disposed within the housing 14. The rotating drum receives clothes or laundry items for drying the items. The dryer 10 may also include a heating unit 21 (see FIG. 13), such as a gas heating unit or an electric heating unit, disposed within the housing 14 for applying heat to the laundry within the rotating drum. FIG. 1 illustrates the door 18 on a horizontal axis dryer 10. The door 18 having the see-through portion can also be used with a dryer having a vertical axis, or with washing machines having either a horizontal or vertical axis.

Figure 3:
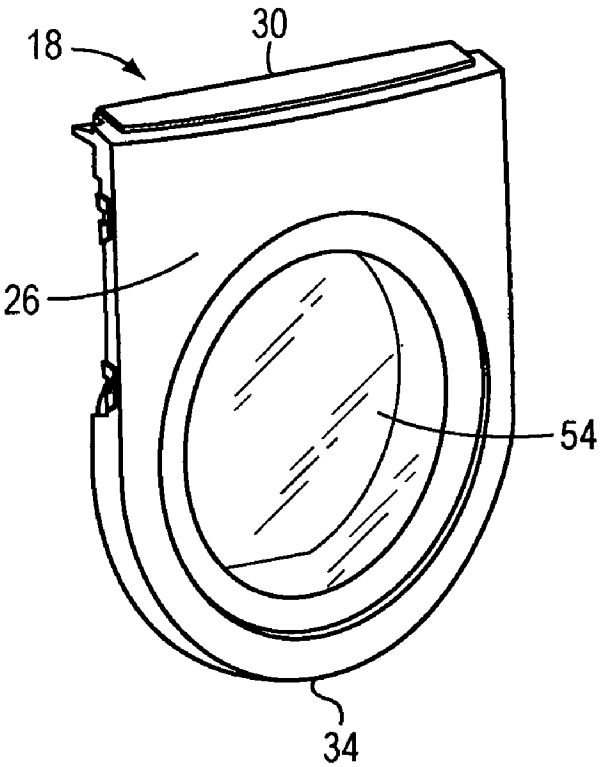
FIG. 3 illustrates a rear perspective view of the door of FIG. 1.
Figure 2:
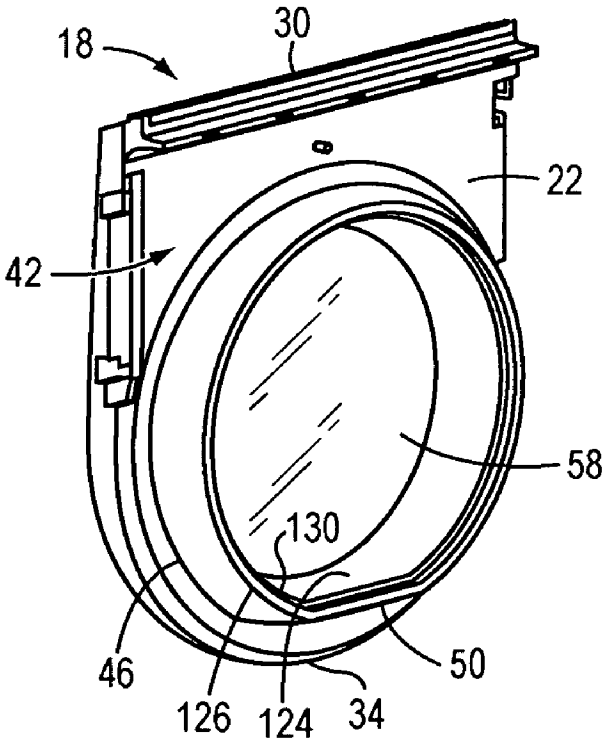
FIG. 2 illustrates a front perspective view of the door of FIG. 1.
Figure 6:
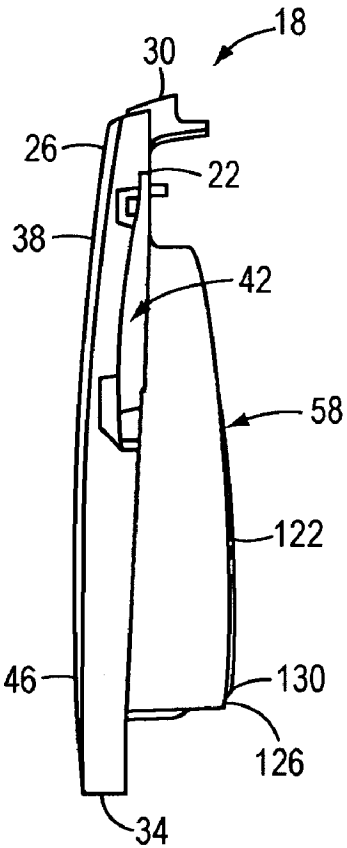
FIG. 6 illustrates a side elevation view of the door of FIG. 1.
Figure 5:
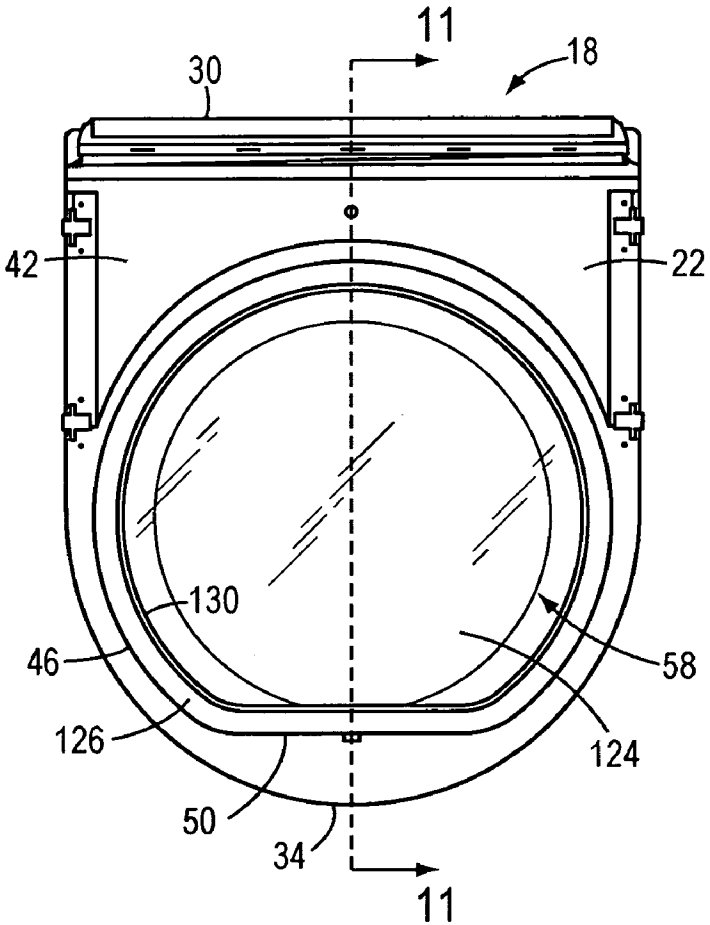
FIG. 5 illustrates a rear elevation view of the door of FIG. 1.
Figure 4:
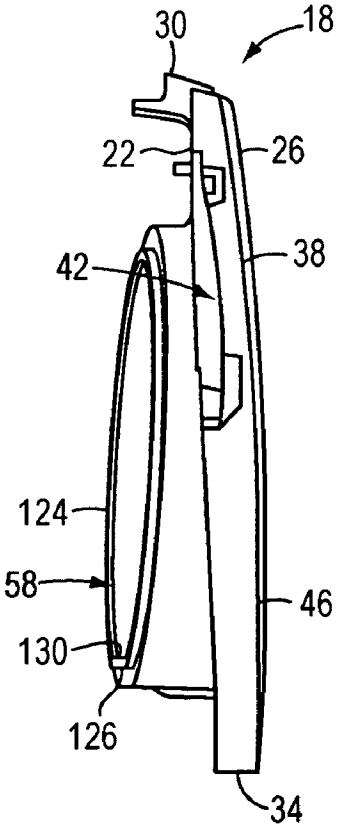
FIG. 4 illustrates a side elevation view of the door of FIG. 1.

FIGS. 2-6 illustrate various views of the door 18 separate from the housing 14 and having a see-through portion near a central area of the door 18. FIG. 2 illustrates a rear side 22 of the door 18 and FIG. 3 illustrates a front side 26 of the door 18. The overall size and shape of the door 18 is irrelevant for the construction of the door. When connected to the housing 14 in a closed condition (See FIG. 1), the rear side 22 faces toward the housing 14 (FIG. 1) and the front side 26 faces away from the housing 14 (FIG. 1). In the illustrated construction, the door 18 is generally U-shaped having a relatively straight upper edge 30 and a rounded lower edge 34. The door 18 includes a door front 38 defining the front side 26 and a door body 42 defining the rear side 22. The door front 38 and the door body 42 are connected to one another to at least partially form the door 18. The door body 42 includes a cylindrical portal 46 projecting outwardly from the rear side 22. As shown in FIGS. 2 and 5, the portal 46 includes a flat portion 50 near the lower edge 34 of the door 18.

In the illustrated construction, the door 18 includes two separate pieces of glass to allow the operator to see through the door 18. A front glass 54 is connected to the door front 38 near the front side 26 and a rear glass 58 is connected to the door body 42 near the rear side 22. The two pieces of glass 54, 58 at least partially define a chamber within the door 18 between the pieces of glass 54, 58. In the illustrated construction, rear glass 58 is made from a solid glass material, such as borosilicate, and the front glass 54 is made from a clear, rigid plastic material, such as styrene acrylonitrile, or SAN. In alternate constructions, the glass pieces 54, 58 can each be made from either a glass or plastic material, or other similar materials that are substantially clear, transparent or translucent.

Figure 7:
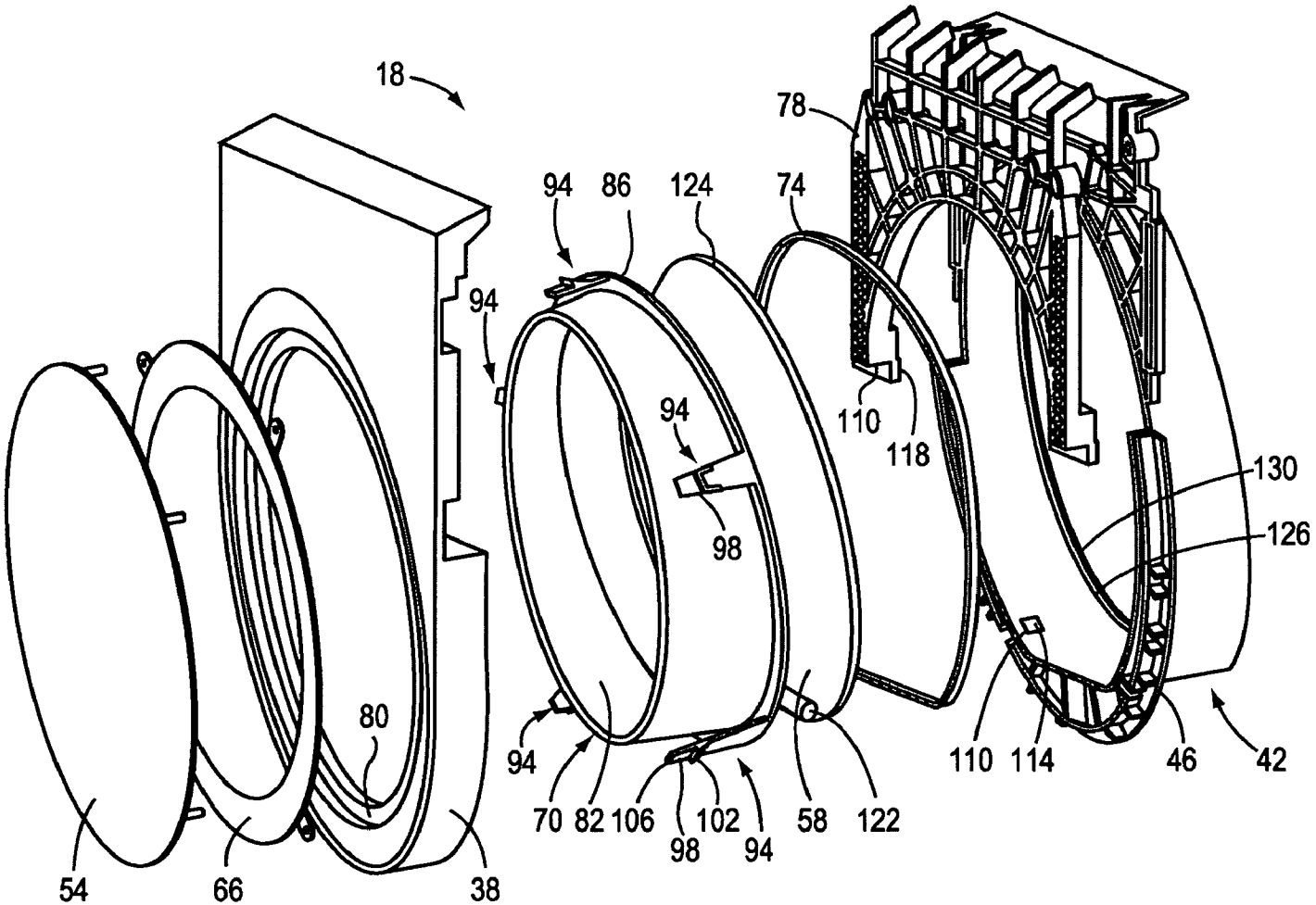
FIG. 7 illustrates an exploded assembly view of the door of FIG. 1.

FIG. 7 illustrates an exploded assembly view of the door 18 showing the various components of the door 18. The door 18 includes the front glass 54, a ring 66, the door front 38, a view guide 70, the rear glass 58, a seal 74, a reinforcement inlay 78, and the door body 42. The front glass 54 and the ring 66 are connected to the door front 38. The door front 38 defines a front aperture 80 and the front glass 54 is connected to the door front 38 over the front aperture 80. In the illustrated construction, multiple posts extend from the front glass 54 and are inserted through corresponding apertures in protruding tabs on the ring 66 and through corresponding apertures in the door front 38. The posts are then fastened to the door front 38 on an opposing side of the door front 38 such that the front glass 54 is substantially flush with front side 26 of the door front 38.

The view guide 70, rear glass 58, seal 74, and reinforcement inlay 78 are connected to the door body 42. The view guide 70 is a tubular structure having a substantially cylindrical portion 82 with a lead edge 86 facing the door body 42. The cylindrical portion 82 includes a smooth inner surface 90 that extends between the front glass 54 and the rear glass 58. Multiple hooks 94 extend back from the lead edge 86 and are spaced apart from the cylindrical portion 82. In the illustrated construction, five hooks 94 extend from the lead edge 86 and are spaced around the perimeter of the view guide 70. The view guide 70 is preferably constructed as an integrally formed molded piece and is made from a resilient plastic material, such as acrylonitrate-butadiene-styrene, or ABS. The view guide 70 is substantially rigid to maintain its desired shaped, but is resilient enough to allow the elongated hooks 94 to flex, similar to a leaf spring, and return to their original position. When the hooks 94 are flexed radially inwardly, the hooks 94 maintain a biasing spring force outwardly toward their original position.

Each hook 94 includes a barb 98 disposed near an end of the hook 94 opposite the lead edge 86. The barb 98 faces radially outwardly from the end of the hook 94 and includes a slanted cam surface 102 and a slanted cam surface 102 and a straight catch surface 106. The cam surface 102 faces toward the lead edge 86 and the catch surface faces away from the lead edge 86.

The hooks 94 engage corresponding receptacles 110 in the door body 42 to connect the view guide 70 to the door body 42 and retain the rear glass 58 between the view guide 70 and the door body 42. In the illustrated construction, the reinforcement inlay 78 and door body 42 are formed as separate pieces and are joined together to form the single door body 42 piece. The door body 42 is preferably constructed as an integrally formed molded piece and is made from a substantially rigid plastic material, such as polypropylene, or PP. The reinforcement inlay 78 is also preferably constructed as an integrally formed molded piece and is made from a substantially rigid plastic material, such as polypropylene, or PP. Alternatively, the door body 42 may be formed as a single integral piece including the portion illustrated as the reinforcement inlay 78.

As shown in FIG. 7, the receptacle 110 includes both apertures 114 defined in the door body 42 and bosses 118 projecting from the door body 42 or reinforcement inlay 78. The view guide 70 is inserted into the portal portion 46 of the door body 42. As the barb 98 approaches the receptacle 110, the slanted cam surface 102 engages a portion of the receptacle 110 and deflects the hook 94 radially inwardly. When the barb 98 fully reaches the receptacle 110, the hook 94 springs back radially outwardly and the catch surface engages the receptacle 110 to retain the view guide 70 in the desired position. When the receptacle 110 includes one of the apertures 114, the hook 94 springs back when the barb 98 is disposed in the aperture 114 and the catch surface 106 engages a portion of the door body 42 defining the aperture 110. When the receptacle 110 includes one of the bosses 118, the hook 94 springs back when the barb 98 travels beyond the boss 118 and the catch surface 106 engages the back side of the boss 118. To remove the view guide 70, the hooks 94 may be bent radially inwardly to disengage the barbs 102 from the receptacles 110, and the view guide 70 may be removed from the door body 42.

Figure 8:
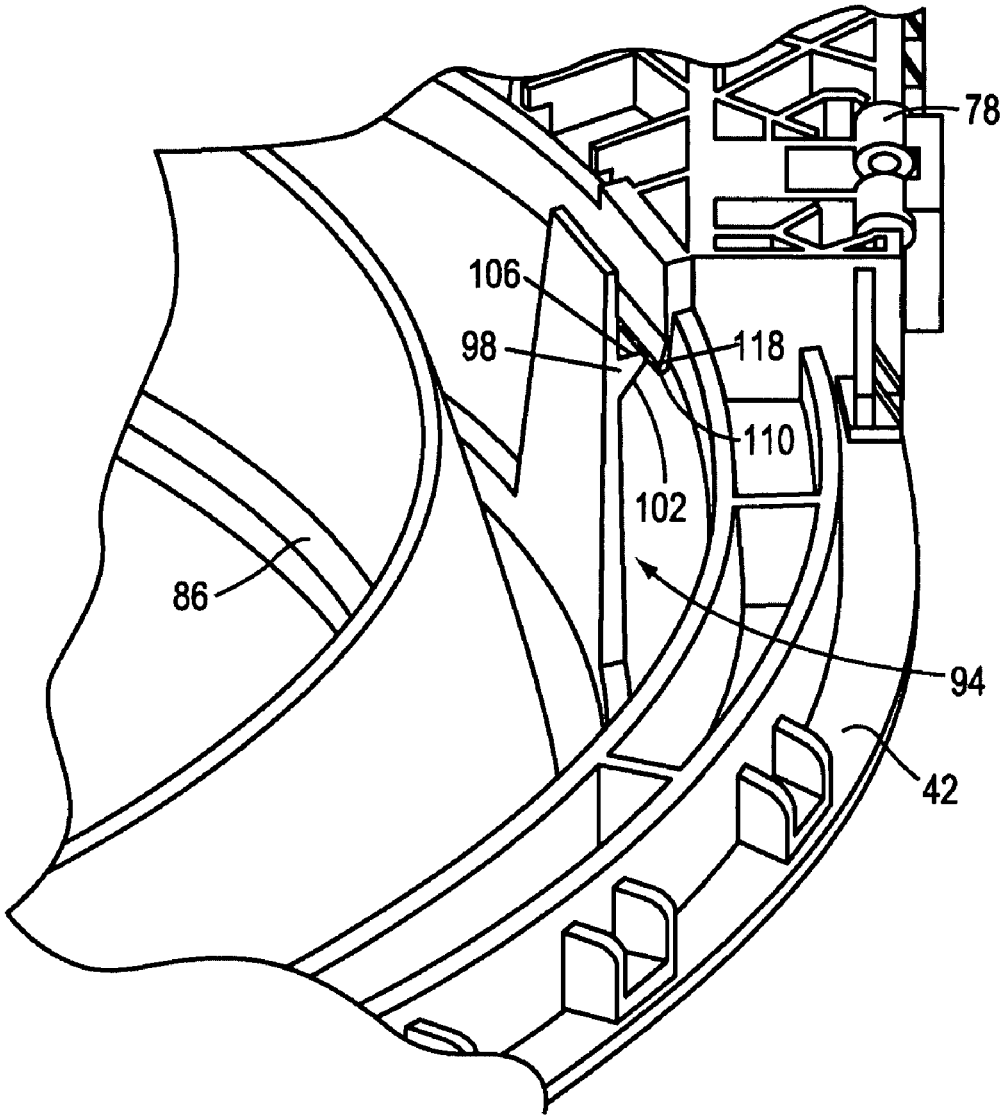
FIG. 8 illustrates an enlarged portion of the door of FIG. 1 showing an engagement of a hook and a receptacle.
Figure 9:
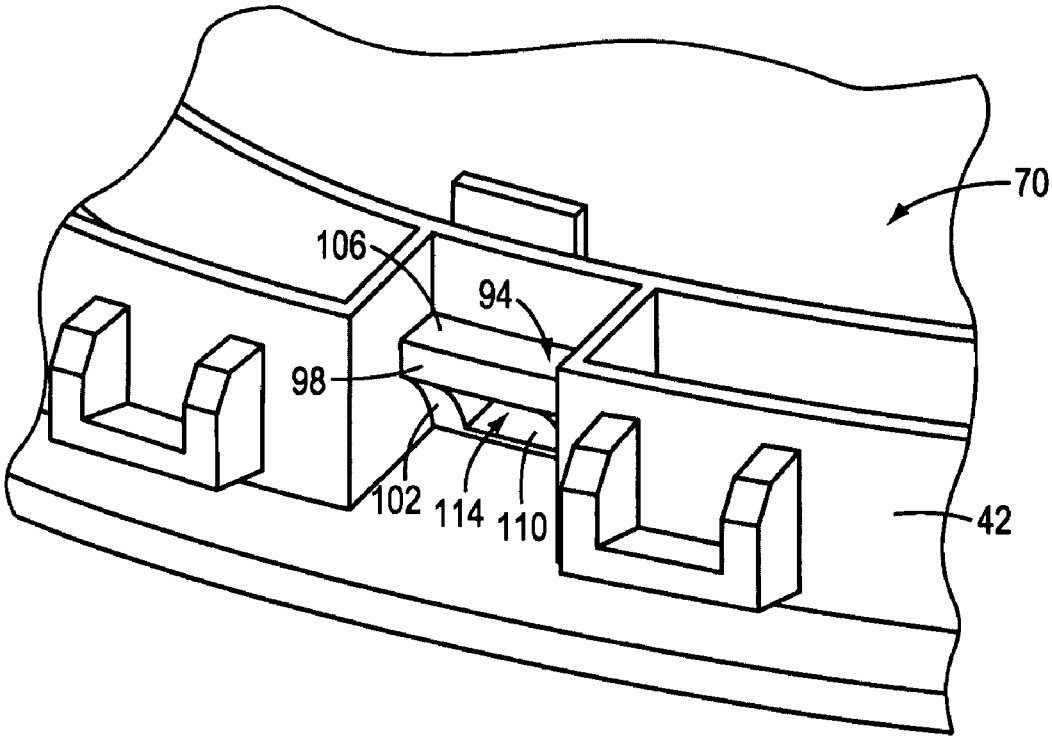
FIG. 9 illustrates an enlarged portion of the door of FIG. 1 showing an engagement of a hook and a receptacle.
Figure 10:
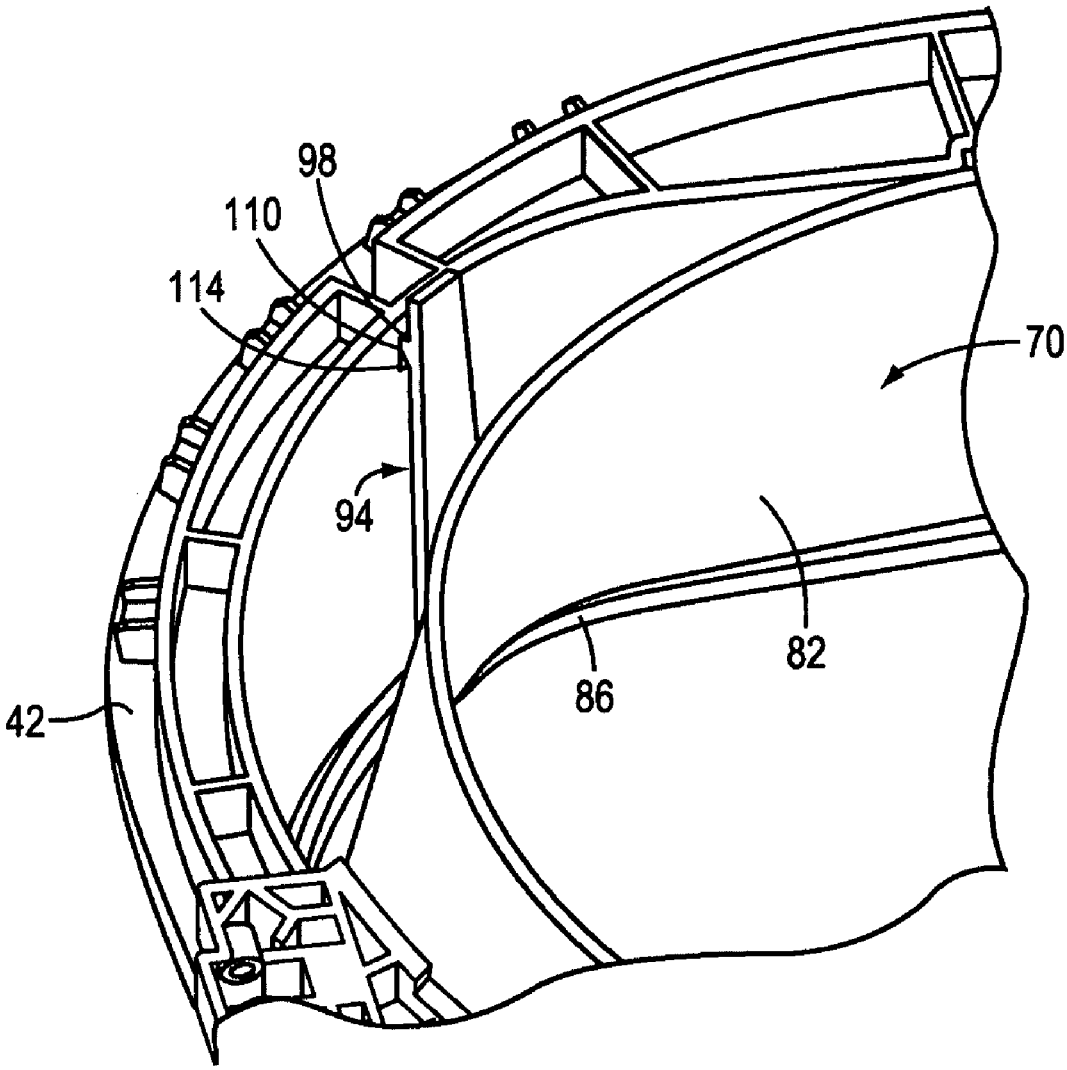
FIG. 10 illustrates an enlarged portion of the door of FIG. 1 showing an engagement of a hook and a receptacle.

FIG. 8 illustrates an enlarged example of one of the hooks 94 engaging one of the bosses 118. The boss 118 projects from the reinforcement inlay 78 and the catch surface 106 of the barb 98 engages the boss 118. FIGS. 9 and 10 illustrate an enlarged example of one of the hooks 94 engaging one of the apertures 114. FIG. 9 illustrates the hook 94 and the aperture 114 from an external perspective, and FIG. 10 illustrates the hook 94 and the aperture 114 from an internal perspective. The barb 98 extends into the aperture 114 and the catch surface 106 engages a portion of the door body 42 defining the aperture 114. The hooks 94 and receptacles 110 form a snap-fit connection between the view guide 70 and the door body 42. In alternate constructions, the receptacles 110 can also include relief cuts, recess, or other similar structures having an edge for engaging the barbs 98 of the hooks 94.

As described above, the quick-release snap-fit connection between the view guide 70 and the door body 42 retains the rear glass 58 in the desired position between the view guide 70 and the door body 42. As shown in FIG. 7, the rear glass 58 includes a stepped flange 122 extending along the outer perimeter of the rear glass 58 and forming a stepped shoulder. A raised central portion 124 of the rear glass 58 bulges outwardly from the flange 122. Also, the door body 42 includes a ridge 126 extending radially inwardly from an end of the portal 46 opposite the rear side 22. The ridge 126 defines a rear aperture 130 near the end of the portal 46 and retains the rear glass 58 within the door body 42. When the door 18 is assembled, the flange 122 of the rear glass 58 is disposed between the ridge 126 of the door body 42 and the lead edge 86 of the view guide 70.

FIG. 7 illustrates the exploded assembly view of the door 18. After the view guide 70 is connected to the door body 42, the door front 38 can be connected to the door body 42 to completely assemble the door 18. The door front 38 can be connected to the door body 42 with a snap fit means, or with screws, rivets or other similar fasteners. When fully assembled, the rear glass 58 and the front glass 54 are disposed at opposite ends of the view guide 70, and the cylindrical portion 82 of the view guide 70 provides a clear viewing path through the door 18 to the inside of the dryer 10 (FIG. 1) and the rotating drum (not illustrated). The front glass 54, view guide 70, and rear glass 58 provide a see-through portion through the door 18.

Figure 11:
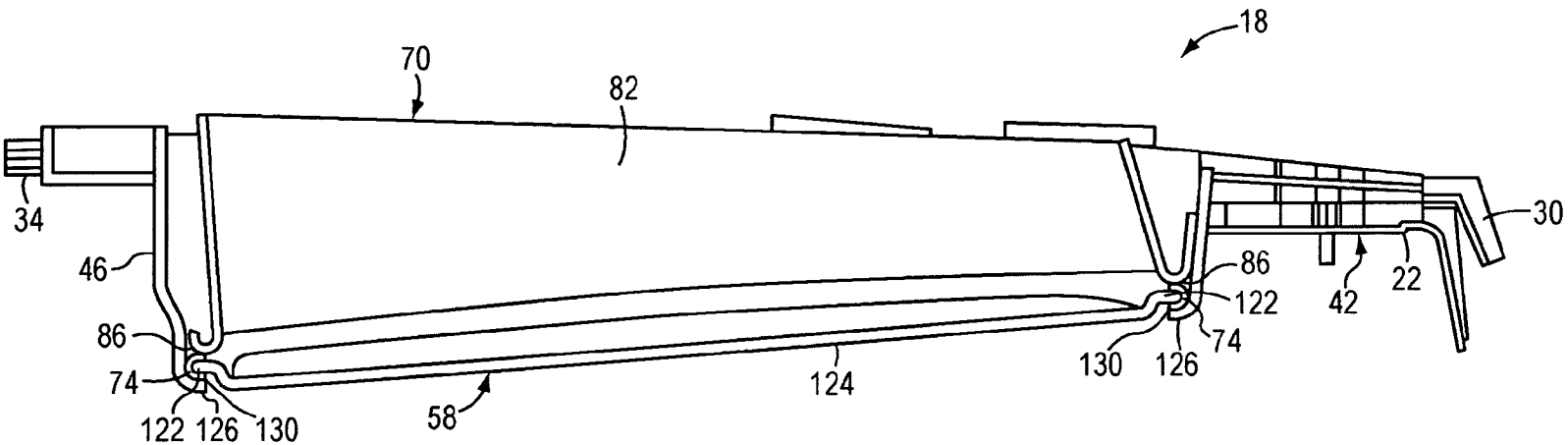
FIG. 11 illustrates a cross-section view of the door taken along line 11-11 of FIG. 5.

FIG. 11 illustrates a cross-section view of the door 18 showing the configuration of the view guide 70, the rear glass 58, and the door body 42. As shown in FIG. 11, the raised central portion 124 of the rear glass 58 bulges outwardly from the flange 122 and extends beyond the ridge 130 and through the rear aperture 130. The seal 74 is positioned adjacent the flange 122 and the ridge 126 to help form a seal between the rear glass 58 and the door body 42. The seal 74 helps resist air, moisture, and particles from passing through the door 18.

Figure 12:
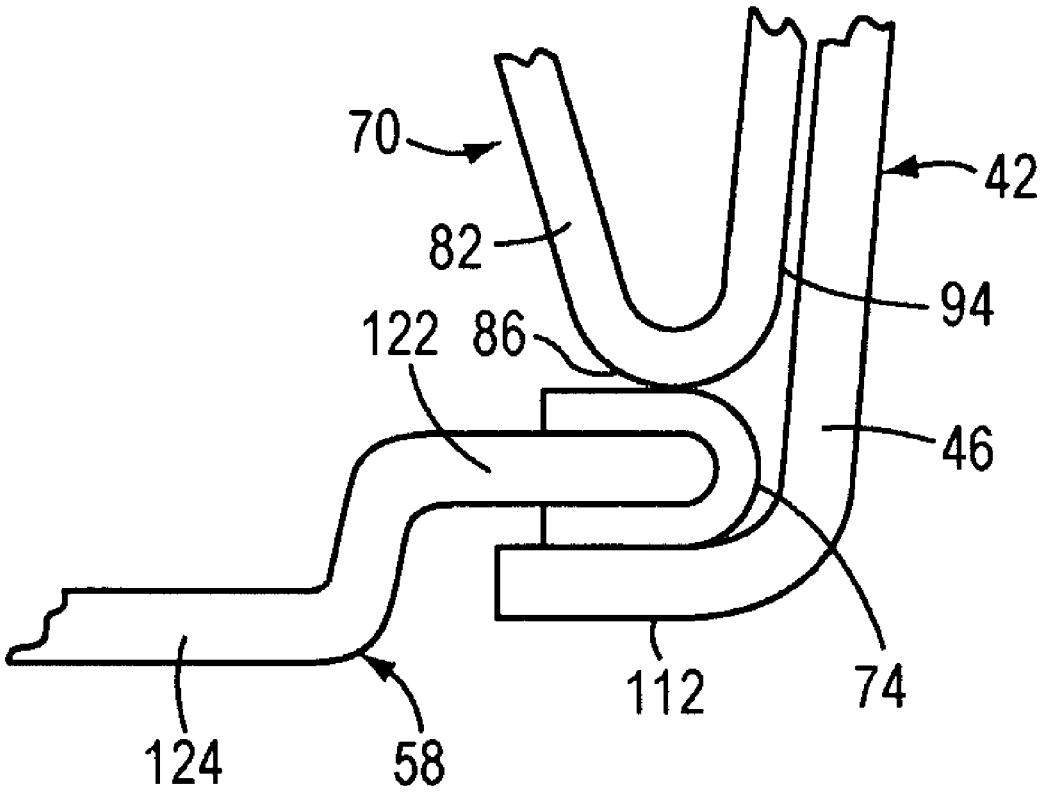
FIG. 12 illustrates an enlarged portion of the cross-sectional view of FIG. 11.

FIG. 12 illustrates an enlarged cross-sectional view of a portion of the door 18 showing the arrangement of the seal 74. In the illustrated construction, the seal 74 can be made from a gasket material having a U-shaped cross-section. The U-shaped seal 74 wraps around the outer edge of the flange 122 such that the flange 122 is disposed between opposing sides of the seal 74. In this configuration, the seal 74 is disposed between the lead edge 86 and the flange 122 and also between the ridge 126 and the flange 122. In alternate constructions, the seal 74 can include an O-ring gasket disposed ridge 126 and the flange 122 or between the lead edge 86 and the flange 122. Alternatively, the seal 74 could include two separate gaskets with a first gasket disposed ridge 126 and the flange 122 and a second gasket disposed between the lead edge 86 and the flange 122

As shown in FIGS. 2, 4-6 and 11, the connection between the rear glass and the door body 42 provides a smooth transition between parts while maintaining smooth surfaces. The raised central portion 124 has a smooth surface that is exposed to the internal drying area of the clothes dryer and may be beneficial during operation of the dryer. The central portion 124 helps resist clothes or laundry within the dryer from catching on the ridge 126. Since the central portion 124 extends beyond the ridge 126, the smooth central portion 124 directs clothes or laundry that may contact the central portion 124 away from the ridge. Also, the raised central portion 124 helps resist lint from being caught on the ridge. The opening of the ridge 126 faces inwardly toward the central portion 124 and helps minimize any raised edges or exposed surfaces that are likely to catch lint.

In addition, the snap-fit connection of the view guide 70 and the door body 42 is almost completely internal within the door 18 and reduces the need for external fasteners projecting out of the rear side. For example, in some prior art devices, screws, rivets, clamps, and other conventional fasteners project out of the door and are exposed to the interior of the dryer. These fasteners provide surfaces or protrusions that may catch laundry or lint particles. In addition, these fasteners of prior art devices are exposed to the heat and moisture conditions within the dryer and may be susceptible to corrosion. In the present invention, the internal connection means of the present invention does not require external fasteners. This connection allows the rear side 22 of the door 18, which is the internal surface facing the drying chamber, to be substantially free from protrusions, projecting surfaces, edges or other obstructions that could negatively affect operation of the dryer.

What is claimed is:

1. A door for a household appliance comprising:

a door body including a cylindrical portal having a ridge extending radially inwardly from an end of the portal and defining a rear aperture, the door body having multiple receptacles adjacent the portal and spaced around the portal;

a rear glass at least partially disposed within the portal and including a flange extending around an outer edge of the rear glass; and a view guide at least partially disposed within the portal and including a cylindrical portion having a lead edge and multiple hooks extending back from the lead edge and being spaced radially outwardly from the cylindrical portion, each hook including a barb near an end of the hook opposite the lead edge facing radially outwardly from the cylindrical portion, each hook engaging a corresponding receptacle to connect the view guide to the door body and retain the rear glass within the door body, the flange of the rear glass being disposed between the ridge of the portal and the lead edge of the view guide.

2. The door of claim 1, wherein the receptacles include an aperture defined by the door body near the portal.

3. The door of claim 1, wherein the receptacles include a boss projecting radially inwardly from the door body near the portal.

4. The door of claim 1, wherein each barb includes a slanted cam surface deflecting the hook when the view guide is being inserted into the door body and a straight catch surface that engages one of the receptacles when the view is fully inserted into the door body to retain the view guide within the door body.

5. The door of claim 1, wherein the door body includes a reinforcement inlay connected to the door body and at least partially defining the cylindrical portal.

6. The door of claim 5, wherein the receptacle includes a boss projecting radially inwardly from the reinforcement inlay near the portal.

7. The door of claim 1, wherein flange forms a stepped shoulder along the outer edge of the rear glass and the rear glass includes a raised central portion bulging outwardly from the flange such that the central portion and the flange are non co-planar, the central portion extending beyond the ridge and through the rear aperture.

8. The door of claim 1, further comprising a seal disposed adjacent the flange and being disposed between the flange and the ridge.

9. The door of claim 8, wherein the seal has a U-shaped cross-section and extends around an outer edge of the flange and contacts the ridge and the lead edge of the view guide.

10. The door of claim 1, further comprising a door front defining a front aperture and having a front glass covering the front aperture, the door front connected to the door body with the front glass and rear glass disposed at opposite ends of the view guide.

11. The door of claim 10, wherein the door front is connected to the door body with a snap-fit connection.

12. A clothes dryer comprising:

a housing;

a rotating drum and a drive device selectively driving the rotating drum disposed within the housing;

a door connected to the housing and being movable between an open condition, in which the rotating drum is accessible, and a closed condition, in which the rotating drum is not accessible, the door comprising:

a door body including a cylindrical portal having a ridge extending radially inwardly from an end of the portal and defining a rear aperture, the door body having multiple receptacles adjacent the portal and spaced around the portal;

a rear glass at least partially disposed within the portal and including a flange extending around an outer edge of the rear glass; and a view guide at least partially disposed within the portal and including a cylindrical portion having a lead edge and multiple hooks extending back from the lead edge and being spaced radially outwardly from the cylindrical portion, each hook including a barb near an end of the hook opposite the lead edge facing radially outwardly from the cylindrical portion, each hook engaging a corresponding receptacle to connect the view guide to the door body and retain the rear glass within the door body, the flange of the rear glass being disposed between the ridge of the portal and the lead edge of the view guide.

13. The dryer of claim 12, further comprising a heating unit disposed within the housing and providing heat to the rotating drum.

14. The door of claim 12, wherein the receptacles include an aperture defined by the door body near the portal.

15. The door of claim 12, wherein the receptacles include a boss projecting radially inwardly from the door body near the portal.

16. The door of claim 12, wherein each barb includes a slanted cam surface deflecting the hook when the view guide is being inserted into the door body and a straight catch surface that engages one of the receptacles when the view is fully inserted to retain the view guide within the door body.

17. The door of claim 12, further comprising a seal disposed adjacent the flange and being disposed between the flange and the ridge.

18. The door of claim 12, further comprising a door front defining a front aperture and having a front glass covering the front aperture, the door front connected to the door body with the front glass and rear glass disposed at opposite ends of the view guide.

19. A method of making a door for a household appliance, the method comprising the acts of:

providing a door body including a cylindrical portal having a ridge extending radially inwardly from an end of the portal and defining a rear aperture, the door body having multiple receptacles adjacent the portal and spaced around the portal;

providing a rear glass at least partially disposed within the portal and including a flange extending around an outer edge of the rear glass;

providing a view guide at least partially disposed within the portal and including a cylindrical portion having a lead edge and multiple hooks extending back from the lead edge and being spaced radially outwardly from the cylindrical portion, each hook including a barb near an end of the hook opposite the lead edge facing radially outwardly from the cylindrical portion;

placing the rear glass within the portal with the flange positioned adjacent the ridge;

inserting the view guide into the portal; and engaging each hook with a corresponding receptacle with a snap-fit connection to connect the view guide to the door body and retain the rear glass within the door body, the flange of the rear glass being disposed between the ridge of the portal and the lead edge of the view guide.

20. The method of claim 19, further comprising:

providing a door front defining a front aperture and having a front glass covering the front aperture; and connecting the door front to the door body with the front glass and rear glass disposed at opposite ends of the view guide.

* * * * *